United States Patent [19]

Krug

[11] 4,226,036

[45] Oct. 7, 1980

[54] BRACELET ASSEMBLY FOR IDENTIFICATION DEVICE

[75] Inventor: Albert E. Krug, Wyckoff, N.J.

[73] Assignee: Becton, Dickinson and Company, Paramus, N.J.

[21] Appl. No.: 970,148

[22] Filed: Dec. 18, 1978

[51] Int. Cl.[3] ..... G09F 3/14

[52] U.S. Cl. ..... 40/21 C; 40/2.2; 24/16 PB

[58] Field of Search ..... 40/2.2, 10 P, 21 R, 40/21 C; 24/16 PB, 17 A, 17 AP

[56] References Cited

U.S. PATENT DOCUMENTS

| | | | |
|---|---|---|---|
| 2,871,592 | 2/1959 | Polzin | 40/21 C |
| 3,645,023 | 2/1972 | Larson | 40/21 C |
| 3,656,247 | 4/1972 | Bushnell et al. | 40/21 C |
| 3,751,835 | 8/1973 | Smith | 40/21 C |
| 3,965,589 | 6/1976 | McDermott | 40/21 C |

*Primary Examiner*—John F. Pitrelli
*Assistant Examiner*—G. Lee Skillington

[57] ABSTRACT

The disclosure is of a bracelet assembly for carrying an identification device, used to transfer identity information to a business record or to generate labels for identification of samples, (blood, urine, etc.) from a medical patient; or medicaments (injectables, parenterals, etc.) to the patient. The assembly is an adjustable bracelet band with a pocket and having an identity tag carried in the pocket. The identity tag is attached to a tether that is secured to the band.

7 Claims, 10 Drawing Figures

Fig.1
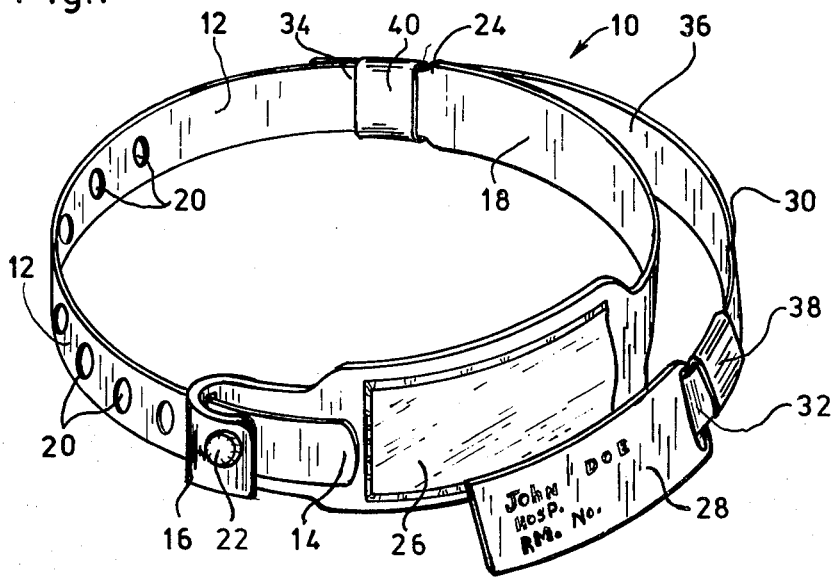
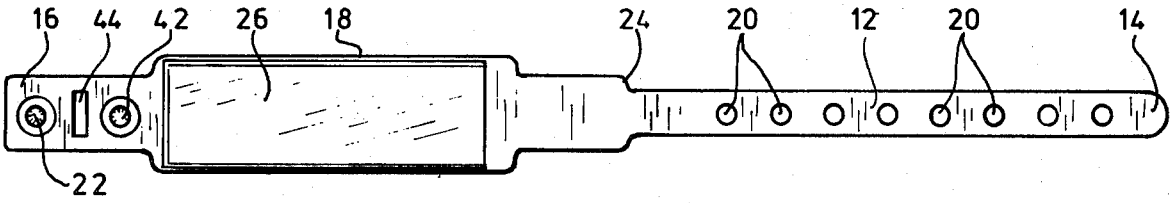
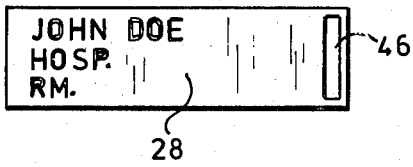
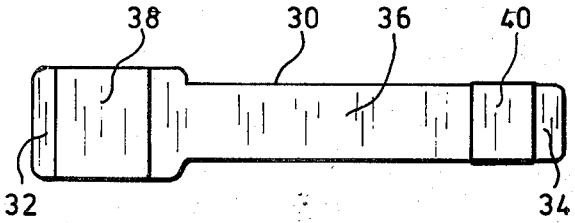
Fig.2

BRACELET ASSEMBLY FOR IDENTIFICATION DEVICE

BACKGROUND OF THE INVENTION

1. Field of the Invention

The invention relates to adjustable identification bracelets for carrying an identification device used to transfer identity information to a business record.

2. Brief Description of the Prior Art

The art is replete with descriptions of bracelet assemblies for carrying identification devices; see for example the disclosures of U.S. Pat. Nos. 2,893,143; 2,954,621; 3,027,665; 3,059,359; 3,645,023; 3,656,247; 3,751,835; and 3,965,589. From the many heretofore available assemblies, it is evident that no single assembly has been satisfactory for all purposes. For example, many of the prior art assemblies are of a structure which inhibits the full movement and use of carried identification devices. The devices must be manipulated and forced, twisted and turned to position them in an information transfer apparatus so that the carried information can be transferred to a business record.

The assembly of the present invention provides for mounting the identity device in such a manner that it is freely available for the transfer of carried information to a business record, and yet it is compactly carried itself so as to be comfortable to the bearer and neat in appearance.

SUMMARY OF THE INVENTION

The invention comprises a bracelet assembly for carrying an identification device used to transfer identity information to a business record, which comprises;

(a) an elongate, flexible, band of a synthetic, polymeric resin, said band having a first end, a second end and a band body joining the first and second ends;

said body having a perforation therein adjacent the first end and adjacent to the second end, a means for association with the perforation to form a permanently closed loop of the band;

a stop means on the band body at a point which is a predetermined distance from the second end;

an open pocket on the band body, positioned between the second end and the stop means, said pocket being adapted by size and configuration to receive the identification device when inserted in the opening thereof; and (b) an elongate, flexible tether having a first end, a second end and a tether body joining the first and second ends of the tether;

means at the first tether end for permanently attaching to the identity device;

means at the second tether end for slidingly mounting the tether on the band body, between the first end of the band and the stop means, said means at the second tether end being stopped by said stop means from sliding between the stop means and the second end of the band, in a direction toward the second end of the band before the permanently closed loop is formed;

said tether being slidingly mounted on the band through the means for the sliding mount;

said tether body having a length less than the aforementioned predetermined distance.

The bracelet assembly of the invention is advantageously assembled on the wrist of a person, for temporary periods, so that positive identification of the individual can be made when necessary and for transferring the identification in a positive manner to business records such as medical order, diagnostic samples and specimens collected from the individual, billing chits and the like.

The terms "permanently closed" and "permanently attaching" as used herein means such closure or attaching which is only reversed by destruction of the assembly of the invention. Such destruction will be readily observable and will serve to alert interested parties to the possibility that positive identification of the individual bearing the assembly may have been compromised.

BRIEF DESCRIPTION OF THE DRAWINGS

FIG. 1 is an isometric view of a preferred embodiment assembly of the invention.

FIG. 2 is a view of the component parts of the assembly shown in FIG. 1, prior to assembly.

DETAILED DESCRIPTION OF THE PREFERRED EMBODIMENTS OF THE INVENTION

Figure 3:
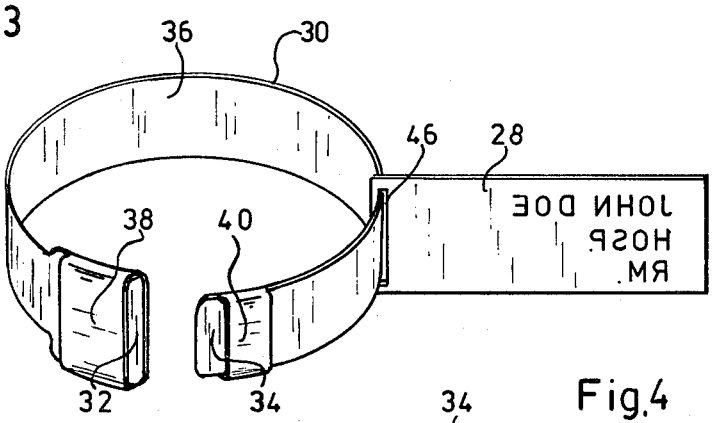
FIG. 3 is an isometric view of the tether component of the assembly shown in FIG. 1 together with an identity tag.

Those skilled in the art will gain an appreciation of the invention from the following description when read in conjunction with the accompanying drawings of FIGS. 1–10, inclusive.

Referring first to FIG. 1, an isometric view of a preferred embodiment bracelet assembly 10 of the invention there is seen an elongate, flexible, band 12 of a synthetic, polymeric resin. Band 12 may be fabricated from any suitable polymeric plasticized resin, such as for example, polyvinyl chloride, and like materials. The band 12 has a first end 14 and a second end 16 and a band body 18 joining the ends 14, 16. Band body 18 has a plurality of perforations 20 therein, adjacent first end 14. Adjacent to second end 16 is a rivet 22 which serves as a means for association with one of the perforations 20 to form a permanently closed loop of band 12 as shown in FIG. 1. Thus, the band 12 is adjustable in size and by selection of an appropriate perforation 20 may be secured to the end 16 through means of rivet 22 to provide a band 12 of any desired diameter. In the preferred embodiment of the invention, the securing of the band ends 14, 16 by use of rivet 22 is such that the loop is permanently closed and cannot be opened without substantial destruction to the band 12. Thus, if the wearer were to make an unauthorized removal of band 12, it would be immediately noticeable under examination. It will also be observed that the band body 18 includes a portion of expanded width which functions as a stop means 24. The function of stop means 24 will be described in greater detail hereinafter. Band body 18 also includes on one outer surface an open pocket 26, formed integrally with the body 18. Pocket 26 is preferably transparent to view and is positioned between the second end 22 and stop means 24. The pocket 26 is adapted by size and configuration to receive the identification device or tag 28. In the FIG. 1, the identification tag 28 is shown removed from pocket 26. The identification tag 28 may be made of any material conventionally employed for fabricating such tags, for example a polymeric resin such as a polycarbonate, polyurethane and like materials. Alternatively, tag 28 may be fabricated from a metal such as steel. The tag 28 bears on its surface indicia for identification purposes of the wearer of the assembly 10 of the invention. Generally, such identification tags are imprinted with raised indicia suitable for use in impression transfer to a business record such as a carbonless reproduction paper, or they may bear machine readable indicia such as bar codes, magnetic recordings, alpha numeric codes and the like. The identity tag 28 is secured to band 12 by a tether 30. Tether 30 is an elongate, flexible tether which may be manufactured from any convenient material such as nylon, leather, synthetic polymeric resin, and the like. Tether 30 has a first end 32 and a second end 34. A tether body 36 joins the ends 32, 34. Affixed in place on end 32 is a sleeve 38 which functions as a means for permanently attaching the tether 30 to the identity tag 28. Permanently affixed to end 34 is another sleeve 40 which functions to make a sliding attachment with band 12 as will be discussed more fully hereinafter.

Referring now to FIG. 2, one can see the component parts of the assembly 10, prior to their assembly. In FIG. 2, one can see the second end 16 of band 12 in an open position exposing rivet 22 and rivet clinch 42. Between rivet 22 and rivet clinch 42 is a slot 44 through which end 14 of band 12 is threaded to bring a perforation 20 into association with the rivet 22 for permanently closing the loop of band 12. The identity tag 28 bears slot 46 in one end for attachment to tether 30 as will be described hereinafter.

Figure 4:
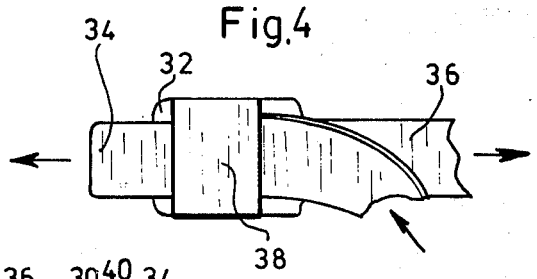
FIG. 4 is a partial view of the tether component shown in FIG. 3, illustrating the means of securing the identity tag.
Figure 5:
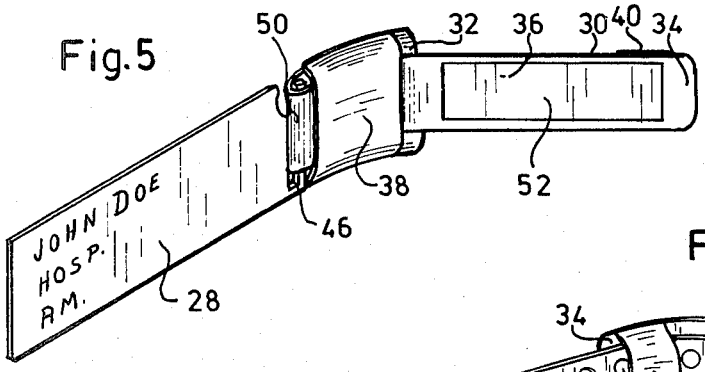
FIG. 5 is a view of the tether shown in FIG. 3, following its securement to the identity tag.

When it becomes desired to attach a permanent form of identification data to an individual, for example a patient in a hospital, the identity tag 28 is provided and may be fabricated to bear the desired indicia of identification. The identity tag 28 with its assembled information is then assembled with the tether 30 as shown in FIG. 3 by threading end 34 of tether 30 through slot 46. The identity tag 28 is then moved toward end 32 of tether 30 and secured adjacent end 32 by inserting and threading end 34 of tether 30 through the inner entrance of sleeve 38 as shown in FIG. 4. When drawn up snug, identity tag 28 is firmly secured within the loop 50 as shown in FIG. 5. When the tether 30, for example, the tape, is of such a shape and dimension to permit, as it is in the embodiment of FIG. 5, there may be mounted on body 36 an open pocket 52, transparent to view, for holding an inserted card. The card may carry additional identity information or may bear indicia for, for example, alert purposes. For example, the inserted card may indicate that a medical patient is sensitive to penicillin.

Figure 6:
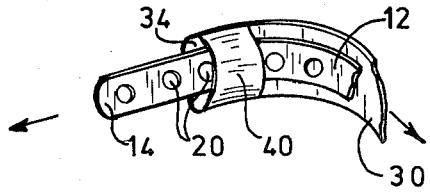
FIG. 6 is a partial view of the tether shown in FIG. 3, being assembled to the bracelet component shown in FIG. 1.
Figure 7:
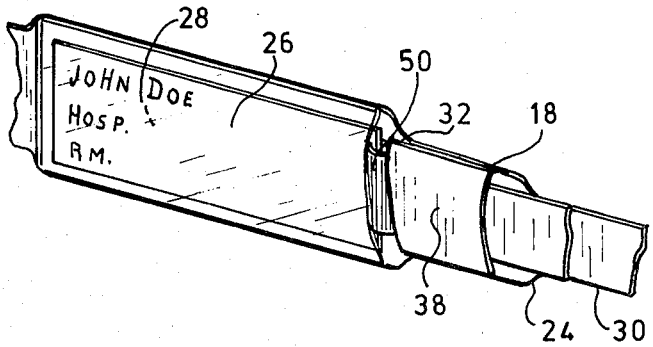
FIG. 7 is a partial view of the assembly shown in FIG. 1, showing mounting of the identity tag.
Figure 8:
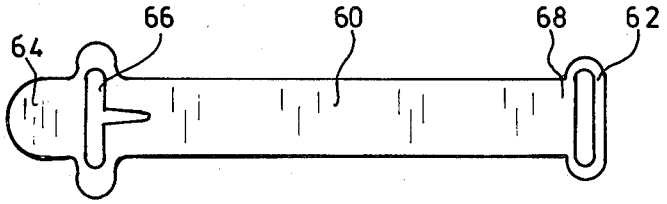
FIG. 8 is a front view of an alternate embodiment tether of the invention.

The assembled identity tag 28 and tether 30 may then be assembled with band 12 as shown in FIG. 6, by threading the end 14 of band 12 through the sleeve 40 on end 34 of tether 30. The sleeve 40 permits tether 30 to slide freely on band 12 up until it meets stop 24. The end 14 of band 12 is then permanently joined to end 16 of band 12 as previously described. The stop means 24 effectively prevents tether 30 from sliding in the zone of band 12 between the stop means and the second end 16 of band 12, in a direction toward the second end of the band before the permanently closed loop is formed. The tether body 36 is preferably selected to have a length less than the distance between the predetermined distance between the stop means 24 and second end 16 of band 12. Thus, the length of tether 30 may be selected so that upon assembly with band 12 the identity disc 28 will fit snugly within pocket 26 as shown in FIG. 7 and the tether 30 will lie flat against band 12 (see FIG. 1). Thus, a neat, compact and easy to wear bracelet assembly 10 is provided.

Figure 9:
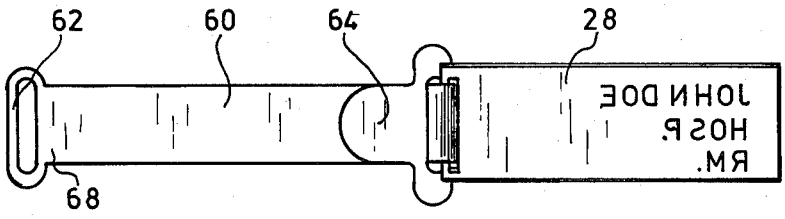
FIG. 9 shows the alternate embodiment tether of FIG. 8, assembled with an identification disc.
Figure 10:
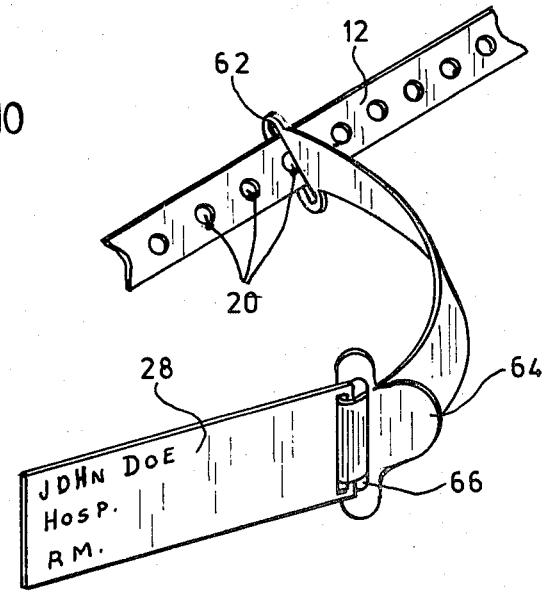
FIG. 10 shows the tether and identify disc of FIG. 9, being assembled to the bracelet seen in FIG. 1.

It will be appreciated by those skilled in the art that many modifications may be made to the above described embodiments of the preferred invention, without departing from the spirit and scope of the invention. For example, referring now to FIG. 8 one may see an alternate embodiment tether 60 which differs from the tether 30 in the means for attachment to both identity disc 28 and band 12. The tether 60 employs a buckle 62 instead of sleeve 40 as shown in the embodiment tether 30. Buckle 60 enables a sliding attachment with band 12 as described above for the tether 30. In the tether 60, the end 64 (corresponding to end 32 of tether 30) has a configuration suitable as a thumb grip. A slot 66 is provided through which end 68 of tether 60 may be threaded to form the closed loop with the identity tag 28, securing it thereby. Referring now to FIG. 9, one can see the assembled tether 60 with identity tag 28. In FIG. 10, one can see assembly of the tether 60 on band 12 in the same manner as was previously employed for sliding engagement of the tether 30.

It will be appreciated by those skilled in the art that the sliding mount of tethers 30, 60 on band 12 greatly facilitates access to the identity tag 28 when it is desired to use tag 28 to transfer information to a business record. This is a significant structural difference over prior art bracelet assemblies wherein the tether component is permanently secured in one position and will not slide around the periphery of the loop formed in the band 12. Thus, it is easier to manipulate the identity tag 28, ultimately secured to band 12, for insertion in information transfer devices for transferring imprinted identification data to business records or to generate labels. The procedure for such transfer and transfer devices is generally well known; see for example U.S. Pat. No. 3,628,722. Alternatively, other well known devices may be employed to "machine read" coded indicia such as magnetic recordings, bar codes and the like and print out information from such readings.

What is claimed is:

1. A bracelet assembly for carrying an identity tag used to transfer identity information to a business record, which comprises;

(a) an elongate, flexible, band of a synthetic, polymeric resin, said band having a first end, a second end and a band body joining the first and second ends;

said body having a perforation therein adjacent the first end and adjacent to the second end, a means for association with the perforation to form a permanently closed loop of the band;

a stop means on the band body at a point which is a predetermined distance from the second end;

an identity tag;

an open pocket on the band body, positioned between the second end and the stop means, said pocket being adapted by size and configuration to receive the identity tag when inserted in the opening thereof; and (b) an elongate, flexible tether having a first end, a second end and a tether body joining the first and second end of the tether;

means at the first tether end for permanently attaching to the identity tag;

means at the second tether end for slidingly mounting the tether on the band body, between the first end of the band and the stop means, said means at the second tether end being stopped by said stop means from sliding between the stop means and the second end of the band, in a direction toward the second end of the band before the permanently closed loop is formed;

said tether being slidingly mounted on the band through the means for the sliding mount;

said tether body having a length less than the aforementioned predetermined distance.

2. The bracelet assembly of claim 1 wherein said means for association with the perforation is a rivet.

3. The bracelet assembly of claim 1 wherein said stop means comprises a widened band body zone.

4. The bracelet assembly of claim 1 wherein said tether is a flat tape, upon which there is a pocket to receive an identity tag.

5. The bracelet assembly of claim 1 wherein the means at the first tether end is a slot for forming a closed loop with the tether body.

6. The bracelet assembly of claim 1 wherein the means at the second tether end is a slot in the tether body.

7. The bracelet assembly of claim 1 wherein the means at the second tether end is a buckle.

* * * * *